US007959515B1

(12) United States Patent
Cruz

(10) Patent No.: US 7,959,515 B1
(45) Date of Patent: Jun. 14, 2011

(54) COMBINATION POOL TABLE HAVING A REBOUND SURFACE CONVERTIBLE FROM EIGHT SIDES TO A CIRCULAR SHAPE AND PORTIONS THEREOF

(76) Inventor: Luis H. Cruz, Bronx, NY (US)

( * ) Notice: Subject to any disclaimer, the term of this patent is extended or adjusted under 35 U.S.C. 154(b) by 31 days.

(21) Appl. No.: 12/454,918

(22) Filed: May 26, 2009

(51) Int. Cl.
*A63D 15/00* (2006.01)
*A63D 15/04* (2006.01)

(52) U.S. Cl. ..... 473/20; 473/8; 473/10; 473/14

(58) Field of Classification Search ..... 473/1, 8–11, 473/13, 18, 20; 273/309
See application file for complete search history.

(56) References Cited

U.S. PATENT DOCUMENTS 364,999 A * 6/1887 Ganter et al. ..... 473/18
435,260 A * 8/1890 Van Brakle ..... 473/13
895,786 A * 8/1908 Perkins ..... 473/16
1,255,542 A * 2/1918 Le Cour ..... 473/18
1,669,822 A * 5/1928 Gregg ..... 473/15
1,725,069 A * 8/1929 Eyles ..... 473/13
3,700,235 A 10/1972 Meyers et al.
3,711,099 A * 1/1973 Milu ..... 473/10
3,801,097 A 4/1974 Van Derhei
4,147,345 A 4/1979 McGovern
4,610,450 A 9/1986 Howell
4,768,781 A 9/1988 McMillin
5,135,218 A 8/1992 McGovern
5,658,202 A 8/1997 McGovern
6,068,558 A 5/2000 Gill et al.

* cited by examiner

*Primary Examiner* — Mitra Aryanpour
(74) *Attorney, Agent, or Firm* — Richard L. Miller

(57) ABSTRACT

A combination pool table having a rebound surface convertible from eight sides to a circular shape and portions thereof being a circular pool table comprising a flat circular playing surface having a plurality of pockets equally spaced around the periphery thereof. A circular rail surrounds the flat circular playing surface. The circular rail has a plurality of sockets in alignment with the pockets. At least one rebound cushion is removably mounted onto the flat circular playing surface against the circular rail between two of the pockets.

6 Claims, 4 Drawing Sheets

COMBINATION POOL TABLE HAVING A REBOUND SURFACE CONVERTIBLE FROM EIGHT SIDES TO A CIRCULAR SHAPE AND PORTIONS THEREOF

BACKGROUND OF THE INVENTION

1. Field of the Invention

The present invention relates to a pool table, and more particularly, a combination pool table having a rebound surface convertible from eight sides to a circular shape and portions thereof.

2. Description of the Prior Art

Numerous innovations for pool tables have been provided in the prior art that will be described. Even though these innovations may be suitable for the specific individual purposes to which they address, however, they differ from the present invention.

A FIRST EXAMPLE, U.S. Pat. No. 3,700,235, Issued on Oct. 24, 1972, to Meyers et al. teaches a circular billiard or pool table having a number of pockets or openings, for receiving billiard balls, which are equally spaced around a circular bumper. Spaced at a mid position between each pocket on the circular bumper is a flat bumper that projects inwards towards the center of the table to prevent billiard balls from traveling a path continuously along the curved bumper to a pocket and also to provide a limited flat bumper surface for rebounding balls.

A SECOND EXAMPLE, U.S. Pat. No. 3,801,097, Issued on Apr. 2, 1974, to Van Derhei teaches a rotatable, round pool table pivoted at the center on a spindle and supported by a plurality of ball bearings which because of a three-point housing support of the balls held therein also provide a braking action against a fixed base. The playing surface of the table is pentagonally shaped, flat and interrupted by depressed, irregular shaped pockets. Additionally, the table has an elevated edge to form the rear enclosure for each of the pockets.

A THIRD EXAMPLE, U.S. Pat. No. 4,147,345, Issued on Apr. 3, 1979, to McGovern teaches a round pool table which has a flat playing surface rimmed by a "cushion" which consists of several rubber tipped segments, any three adjacent of which at option of a player can be raised to an upright position, thereby establishing a pocket.

A FOURTH EXAMPLE, U.S. Pat. No. 4,610,450, Issued on Sep. 9, 1986, to Howell teaches a circular billiard or pool table having a plurality of pockets equally spaced around the table with the pockets being spaced radially inwardly from the perimeter of the table. A cushion rail around the perimeter of the table has inwardly projecting bumpers extending towards respective pockets, with the innermost edges of the bumpers being spaced from the respective pockets. The inwardly facing edge of the cushion rail forms a substantially concave smooth, continuous face between the bumpers.

A FIFTH EXAMPLE, U.S. Pat. No. 4,768,781, Issued on Sep. 6, 1988, to McMillin teaches a game device including a bordered playing field having a number of pockets formed in the field to receive target balls. The device includes a star-shaped rack having five spaced compartments, each of which receives and aligns a group of three target balls in a broken ring around a centrally positioned target ball. The shooter ball is positioned outside the ring and the game player uses a cue stick to strike and propel the shooter ball toward an appropriate target ball. The height of the playing field is adjustable and the playing field rotates to provide convenient access to elderly or handicapped players. The device is also conveniently disassembled for storage or shipping.

A SIXTH EXAMPLE, U.S. Pat. No. 5,135,218, Issued on Aug. 4, 1992, to McGovern teaches an improved circular pool table comprised of a flat surface rimmed by a ball rebound cushion comprised of a plurality of rubber tipped bumper segments, any one of which can be pivoted to an upright position to expose a segment pocket. Each segment is combined with a rotatable ring which encircles the playing surface and which carriers a plurality of tabs which correspond with a bumper segment. Each tab is provided with game point indicia to display game point values and is in 1 to 1 correspondence with a respective segment. Each time the ring is rotated the point value associated with each segment/pocket is changed. When a bumper segment is disposed horizontally the line of sight to its tab is blocked by a flap that is fastened to the bottom of each bumper segment, and when a segment is raised to a vertical position to form a segment/pocket the line of sight to its corresponding tab is unobstructed and the point value associated with the pocket is visible and readable.

A SEVENTH EXAMPLE, U.S. Pat. No. 5,658,202, Issued on Aug. 19, 1997, to McGovern teaches an improved circular pool table comprised of a flat surface rimmed by a ball rebound cushion comprised of a plurality of rubber tipped bumper segments, any one of which can be pivoted to an upright position to expose a segment pocket. Two brackets are superimposed on the table top. Each bracket carries an elongated cushion. The cushions are spaced apart and parallel. A new playing area shape is created where an equal number of segments are left uncovered at its ends. One bracket face displays a plurality of diagramed game plays, in frames. The other bracket face displays a plurality of score indicator units that correspond to the plays. Each segment has a graduated grooved plate fastened to its top surface. The invention supports a new game system. A player, following a diagram, launches a ball onto said playing area via the plate and then shoots to sink the game ball. The opponent must make the same diagramed play and shot. Awarded points are registered on the indicators. Points for missed shots are held in a jackpot and awarded in a playoff.

AN EIGHTH EXAMPLE, U.S. Pat. No. 6,068,558, Issued on May 30, 2000, to Gill et al. teaches a billiard type game that includes a table having a top plate with a hexagonal configuration and a vertically oriented pocket formed in each corner thereof. Also included is a plurality of balls, a pair of cue sticks and a rack with a hexagonal configuration.

It is apparent now that numerous innovations for pool tables have been provided in the prior art that adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a combination pool table having a rebound surface convertible from eight sides to a circular shape and portions thereof that avoids the disadvantages of the prior art.

ANOTHER OBJECT of the present invention is to provide a combination pool table having a rebound surface convertible from eight sides to a circular shape and portions thereof that is simple and inexpensive to manufacture.

STILL ANOTHER OBJECT of the present invention is to provide a combination pool table having a rebound surface convertible from eight sides to a circular shape and portions thereof that is simple to use.

BRIEFLY STATED, STILL YET ANOTHER OBJECT of the present invention is to provide a combination pool table having a rebound surface convertible from eight sides to a circular shape and portions thereof being a circular pool table comprising a flat circular playing surface having a plurality of pockets equally spaced around the periphery thereof. A circular rail surrounds the flat circular playing surface. The circular rail has a plurality of sockets in alignment with the pockets. At least one rebound cushion is removably mounted onto the flat circular playing surface against the circular rail between two of the pockets.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

A MARSHALING OF REFERENCE NUMERALS UTILIZED IN THE DRAWING

Figure 1:
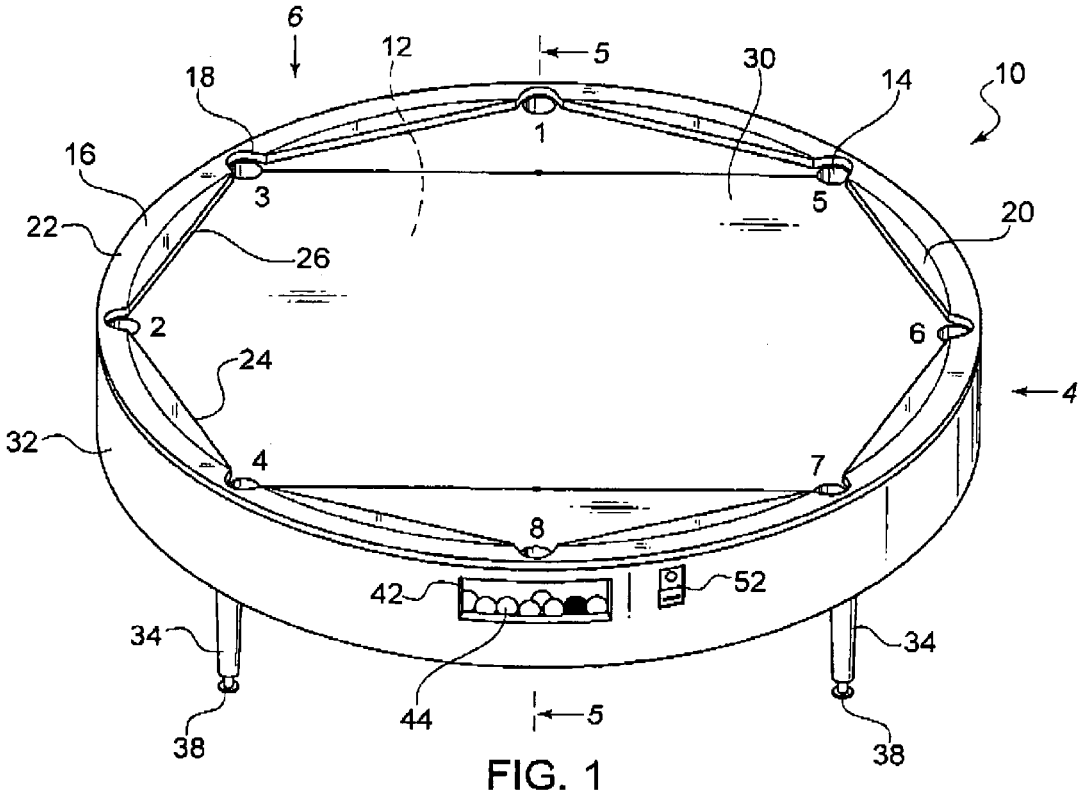
FIG. 1 is a diagrammatic perspective view of the pool table of an embodiment of the present invention.

10 circular pool table
12 flat circular playing surface of circular pool table 10
14 pocket in flat circular playing surface 12
16 circular rail of circular pool table 10
18 socket in circular rail 16
20 rebound cushion of circular pool table 10
22 curved rear edge of rebound cushion 20
24 flat front edge of rebound cushion 20
26 bottom surface of rebound cushion 20
28 hook mounting strip on bottom surface 26
30 felt cloth on flat circular playing surface 12
32 circular table frame of circular pool table 10
34 leg is circular pool table 10
36 floor
38 leveler foot on leg 34
40 channel system in circular table frame 32
42 single ball return port in circular table frame 32
44 object ball for circular pool table 10
46 cue ball for circular pool table 10
48 rack for circular pool table 10
50 cue stick for circular pool table 10
52 coin slot in circular table frame 32

DETAILED DESCRIPTION OF THE PREFERRED EMBODIMENT

Referring now to the figures, in which like numerals indicate like parts, and particularly to FIGS. 1 through 6, which are a diagrammatic perspective view of the pool table of an embodiment of the present invention; a diagrammatic top view showing the rack, balls and cue stick of the present invention; a diagrammatic perspective view similar to FIG. 1 but with the eight rebound cushions exploded therefrom; a diagrammatic side view taken in the direction of arrow 4 in FIG. 1; a diagrammatic cross sectional view taken on line 5-5 of FIG. 1, showing one of the rebound cushions about to be installed thereon; and a diagrammatic top view taken in the direction of arrow 6 in FIG. 1, showing the interconnected channel system to form a single return port, in phantom, and as such, will be discussed with reference thereto.

The present invention is a combination pool table having a rebound surface convertible from eight sides to a circular shape and portions thereof being a circular pool table 10 comprising a flat circular playing surface 12 having a plurality of pockets 14 equally spaced around the periphery thereof. A circular rail 16 surrounds the flat circular playing surface 12. The circular rail 16 has a plurality of sockets 18 in alignment with the pockets 14. At least one rebound cushion 20 is removably mounted onto the flat circular playing surface 12 against the circular rail 16 between two of the pockets 14.

The at least one rebound cushion 20 comprises a curved rear edge 22 to fit against the circular rail 16. A flat front edge 24 extends into the flat circular playing surface 12. A bottom surface 26 having a hook mounting strip 28 is removably mounted onto a felt cloth 30 on the flat circular playing surface 12.

The circular pool table 10 further comprises a circular table frame 32 to support the flat circular playing surface 12 and the circular rail 16. A plurality of legs 34 are mounted to bottom of the circular table frame 32 to elevate the circular table frame 32 above a floor 36. Each leg 34 further comprises a leveler foot 36 to stabilize the circular table frame 32 with respect to the floor 36.

There are eight pockets 14 equally spaced around the periphery of the flat circular playing surface 12 and there are eight rebound cushions 20. The circular pool table 10 further comprises the circular table frame 32 having disposed therein a channel system 40 interconnecting the eight pockets 14 with a single ball return port 42 (see FIGS. 5 and 6).

Figure 2:
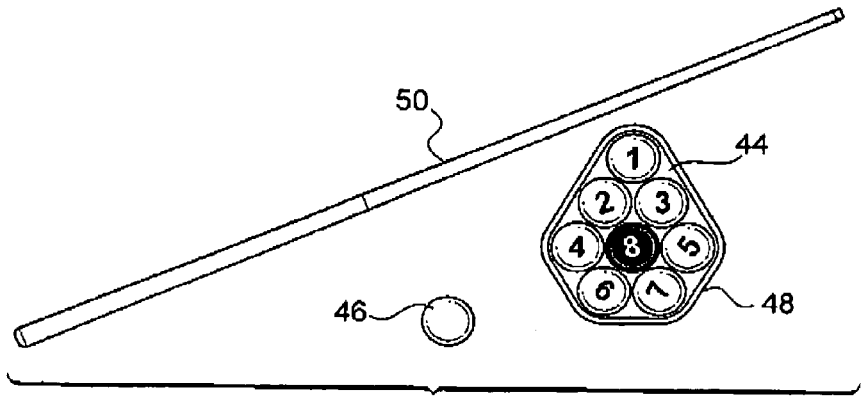
FIG. 2 is a diagrammatic top view showing the rack, balls and cue stick of the present invention.
Figure 3:
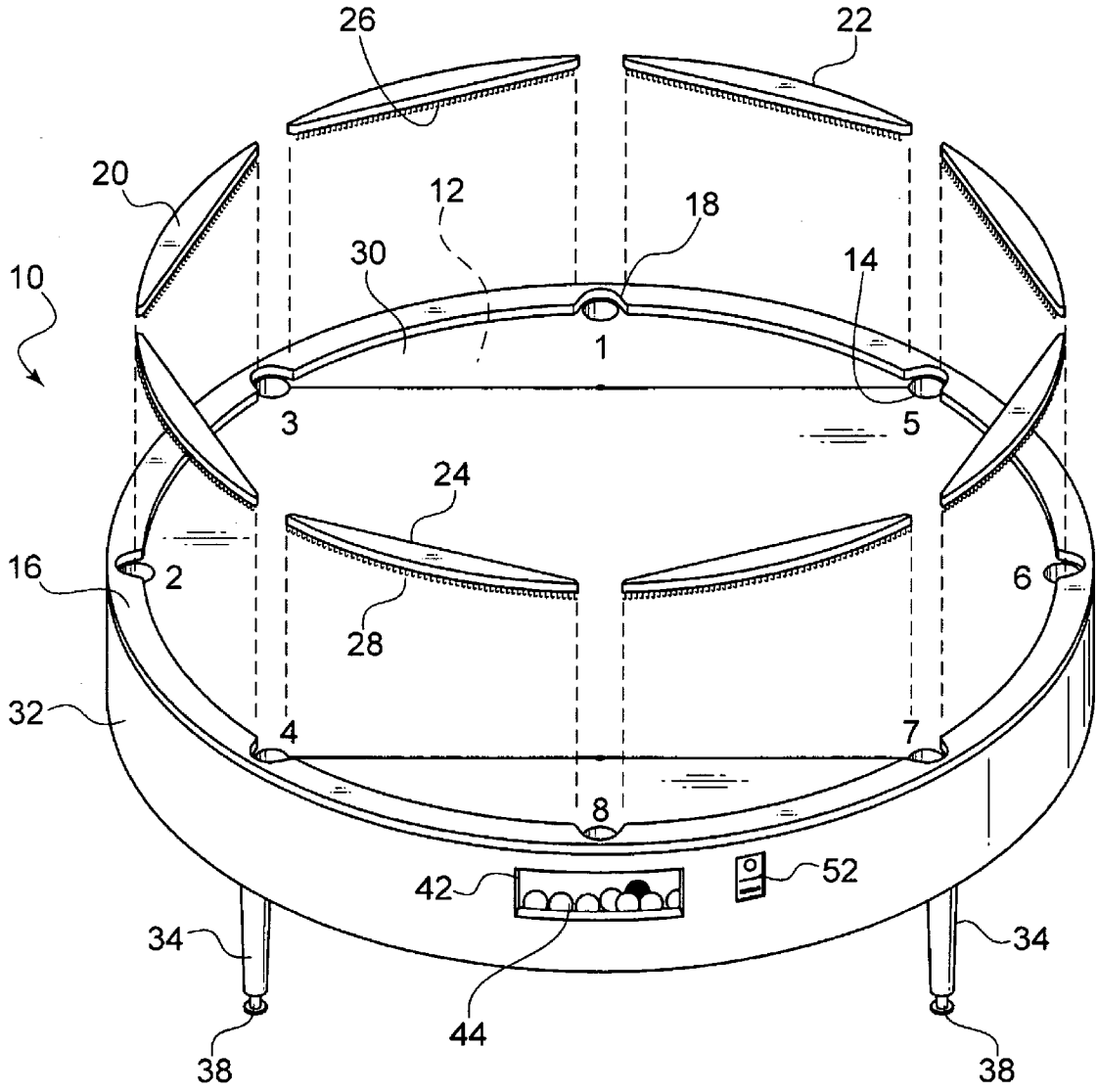
FIG. 3 is a diagrammatic perspective view similar to FIG. 1 but with the eight rebound cushions exploded therefrom.
Figure 4:
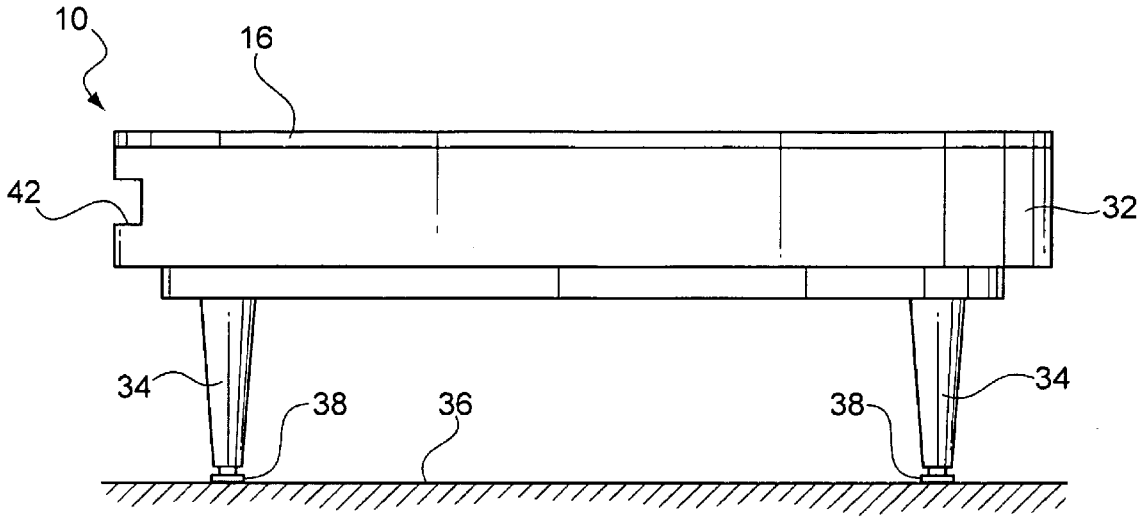
FIG. 4 is a diagrammatic side view taken in the direction of arrow 4 in FIG. 1.
Figure 5:
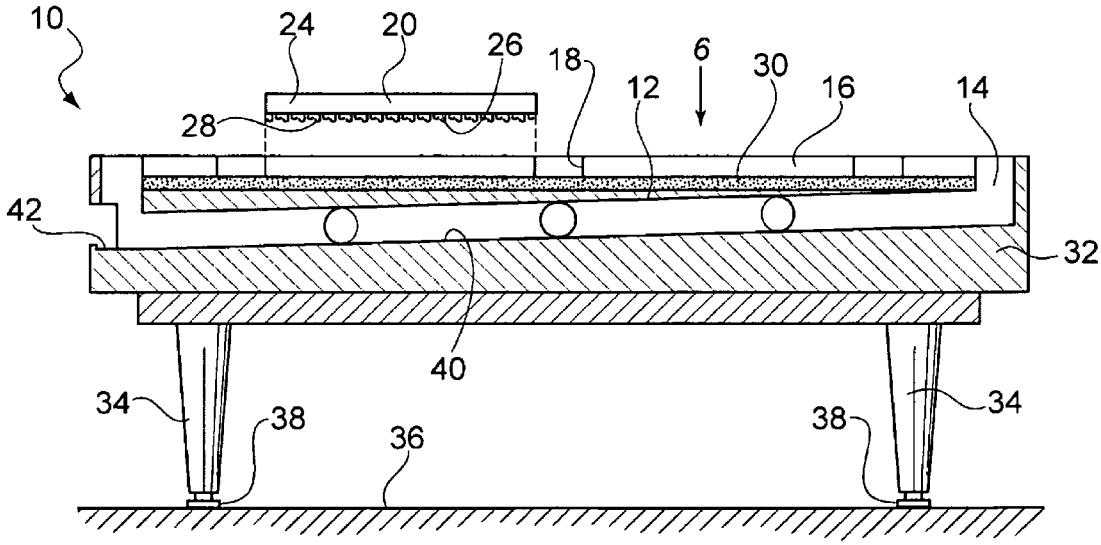
FIG. 5 is a diagrammatic cross sectional view taken on line 5-5 of FIG. 1, showing one of the rebound cushions about to be installed thereon.
Figure 6:
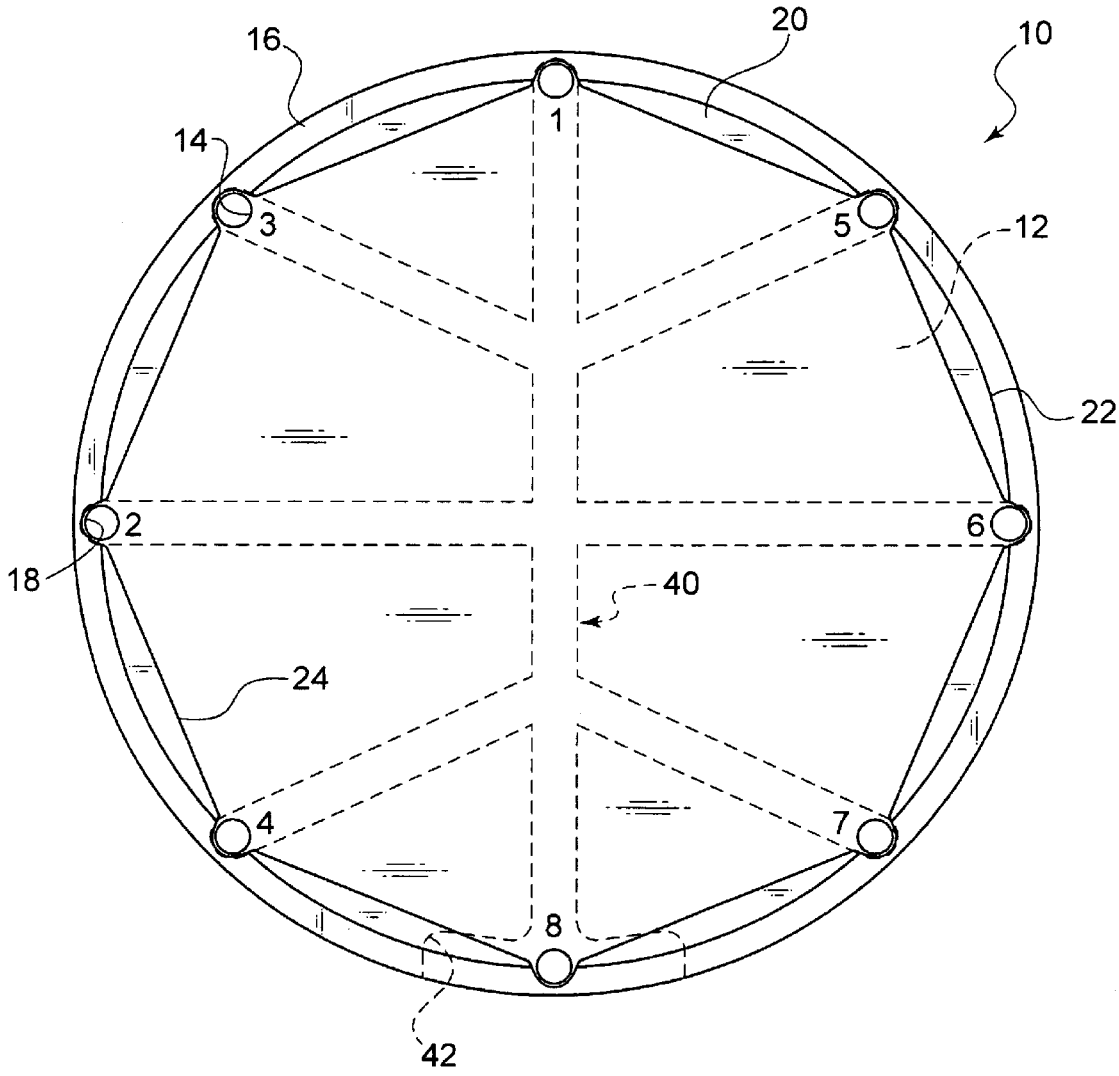
FIG. 6 is a diagrammatic top view taken in the direction of arrow 6 in FIG. 1, showing the interconnected channel system to form a single return port, in phantom.

The circular pool table 10, as shown in FIG. 2, further comprises eight object balls 44, a cue ball 46, a rack 48 to set up the object balls 44 on the flat circular playing surface 12, and a cue stick 50. The circular pool table 10, as shown in FIGS. 1 and 3, further comprises a coin slot 52 located in the circular table frame 32 adjacent to the single ball return port 42.

Rules of the Game

The object of the game is to enter all balls into their corresponding pockets, for example ball number one into the first pocket, ball number two into the second pocket, etc. The player who shoots the eight ball into the eight pocket on their turn wins the game.

1. First set the balls with the rack on the flat circular playing surface.

2. Players get ready to break the set of balls to begin the game.

3. First shot wins: When breaking the set of balls, if the eight ball enters the eight pocket, this is an automatic win even if other balls enter other pockets.

4. If you don't get an automatic win, the game will continue as follows, each ball must enter into its corresponding pocket in numeric order.

5. Players will continue to play until the eight ball enters the eight pocket.

6. If any player shoots a ball into an incorrect pocket the player must pass the cue stick to the next player.

7. If a player shoots and hits a ball and the eight ball enters a different pocket this is an automatic loss.

8. After the first shot of each player all balls must be entered into their pockets. If the eight ball falls into any pocket that is a loss.

9. The only way to win the game is by an automatic win (first shot only) or taking your turn at the eight ball.

It will be understood that each of the elements described above, or two or more together, may also find a useful application in other types of constructions differing from the types described above.

While the invention has been illustrated and described as embodiments of a combination pool table having a rebound surface convertible from eight sides to a circular shape and portions thereof, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A combination pool table having a rebound surface convertible from eight sides to a circular shape and portions thereof being a circular pool table comprising:

a) a flat circular playing surface having a plurality of pockets equally spaced around the periphery thereof;

b) a circular rail surrounding said flat circular playing surface, said circular rail having a plurality of sockets in alignment with said pockets; and c) at least one rebound cushion removably mounted onto said flat circular playing surface against said circular rail between two of said pockets;

wherein said at least one rebound cushion comprises:

a) a curved rear edge to fit against said circular rail;

b) a flat front edge to extend into said flat circular playing surface; and c) a bottom surface having a hook portion of hook and loop fasteners mounting strip to removably onto a felt cloth on said flat circular playing surface.

2. The circular pool table as recited in claim 1, further comprising:

a) a circular table frame to support said flat circular playing surface and said circular rail; and b) a plurality of legs mounted to bottom of said circular table frame to elevate said circular table frame above a floor.

3. The circular pool table as recited in claim 2, wherein each said leg further comprises a leveler foot to stabilize said circular table frame with respect to the floor.

4. The circular pool table as recited in claim 3, wherein there are eight pockets equally spaced around the periphery of said flat circular playing surface and there are eight rebound cushions, said circular pool table further comprising said circular table frame having disposed therein a channel system interconnecting said eight pockets with a single ball return port.

5. The circular pool table as recited in claim 4, further comprising:

a) eight object balls;

b) a cue ball;

c) a rack to set up said object balls on said flat circular playing surface; and d) a cue stick.

6. The circular pool table as recited in claim 5, further comprising a coin slot located in said circular table frame adjacent said single ball return port.

* * * * *